US005687654A

United States Patent [19]

Huggins

[11] Patent Number: 5,687,654

[45] Date of Patent: Nov. 18, 1997

[54] VERTICALLY ADJUSTABLE TABLE

[76] Inventor: Lloyd Huggins, P.O. Box 405, 20 Bagley Ave., Bucksport, Me. 04416

[21] Appl. No.: 631,263

[22] Filed: Apr. 12, 1996

[51] Int. Cl.[6] ..... A47B 9/00

[52] U.S. Cl. ..... 108/147; 108/106

[58] Field of Search ..... 108/144, 147, 108/42, 106, 10; 248/188.2, 188.3, 162.1, 648; 297/273, 337

[56] References Cited

U.S. PATENT DOCUMENTS

| | | | |
|---|---|---|---|
| 575,747 | 1/1897 | Whitney | 108/106 |
| 677,802 | 7/1901 | Rohrer | 108/106 X |
| 1,583,887 | 5/1926 | Kilbourn | 108/106 |
| 3,000,683 | 9/1961 | MacNeary | 108/106 X |
| 3,081,972 | 3/1963 | Gray, Jr. | 108/10 X |
| 5,402,736 | 4/1995 | Dausch | 108/144 |
| 5,456,191 | 10/1995 | Hall | 108/147 |

FOREIGN PATENT DOCUMENTS

| | | | |
|---|---|---|---|
| 455248 | 10/1924 | Germany | 108/144 |
| 367951 | 4/1963 | Switzerland | 108/10 |
| 23297 | of 1898 | United Kingdom | 108/147 |

*Primary Examiner*—Jose V. Chen
*Attorney, Agent, or Firm*—William B. Ritchie

[57] ABSTRACT

A vertically adjustable table appropriate for use with a chair or wheelchair whereby the table surface remains in a fixed horizontal plane and is adjustable only along the vertical plane. The table surface may be manually adjusted along guideposts with the use of a cable and pulley system, such that the user may easily adjust the table by pulling the table surface down for use and lift the table surface up when it is no longer in use. The guideposts are of sufficient length to allow the user to easily maneuver underneath the table surface when the table surface is in a raised position. This system is of particular use for individuals with physical limitations.

5 Claims, 2 Drawing Sheets

VERTICALLY ADJUSTABLE TABLE

BACKGROUND OF THE INVENTION

1. Field of the Invention

This invention relates to tables, specifically adjustable tables for use with chairs or wheelchairs.

2. Description of Related Art

Individuals with physical limitations often find it difficult to maneuver to and around standard tables. It is often the case that an individual will find it desirable to sit in a comfortable chair, but also have a need for access to a table while they are seated. In situations where an individual has limited mobility, the ability to bring a table to their sitting position is quite difficult. In the past, tables with wheels have been used for this purpose. However, this type of table is often cumbersome and difficult to use, especially by the patient alone. Usually, an assistant must wheel the table to the seated patient since the patient is frequently unable to accomplish it by him/herself. If the patient wishes to exit the chair, then, the assistant must roll away the table before the patient can get up. Chairs have been developed which allow a patient with limited mobility to exit a chair by him/herself. However, the use of present tables defeat the independence provided by chairs that raise and tilt to move the patient to an almost standing position. If a table with wheels has not been rolled away by an assistant, the table would be an obstruction when the user attempts to move away from his/her chair. This is important particularly in cases where the user has limited mobility, but is seated in a standard chair. In addition, in an area with limited space a wheelchair bound user will find difficulty maneuvering his/her chair around and away from a table, even if the table possesses wheels for mobility. Lap tables have also been used by individuals with physical limitations. However, this type of table lacks stability and is often uncomfortable when used for long periods of time.

U.S. Pat. No. 3,915,102 provides for a wheelchair table which has wheels for the purpose of moving the table towards and away from a wheelchair. There is also a provision for a telescoping component which positions the table at the desired height. This apparatus necessitates that the user either approach the table or that the table be moved to the user. Unfortunately, this apparatus is not easily accessible for individuals seated in a standard chair. Either a third party must position the table or the user must reach for a closely positioned table. This presents difficulties if the user does not possess sufficient balance to reach for and move a wheeled table or if it is inconvenient to position the table close to the user.

U.S. Pat. No. 660,868 discloses a table for use by opticians which moves vertically. The table is attached to only a single stand with a limited vertical reach. As with the '102 patent discussed above, this apparatus would not be appropriate for use by physically limited individuals seated in a standard chair.

Nothing in the prior art provides for or suggests a table which allows a physically limited user to easily access and remove a table while in a seated position and permits that user to get up from the chair without the use of an assistant once the table has been set into place.

SUMMARY OF THE INVENTION

It is a principal aspect of the present invention to provide a new and useful table with minimal obstructions for individuals with physical limitations.

It is another aspect of the present invention to provide a table which can be approached with minimal effort.

It is still another aspect of the present invention to provide a table with vertical mobility and horizontal stability.

Another aspect of the invention is to provide a vertically adjustable table that can be easily removed so that a seated patient can exit the chair without needing an assistant to remove the table.

The present invention includes a horizontally fixed table which allows the user to adjust the table surface in a vertical plane such that the user may easily pass under the elevated table surface to reach or exit the user's chair and such that the user may easily bring the table surface within the user's reach. This apparatus includes a table having two substantially vertical support members. A pulley system is attached to each support member with a cable mechanism attached to opposing sides of the table surface, each cable running through the pulley system and attached to a counter weight on the opposite end of the cable mechanism. The table surface may be raised along the vertical support members to allow for an individual to easily pass beneath the table surface. When the table surface is lowered, it will easily rest on the arms of a chair or the lap of the user. The width between the support members is sufficient to allow for the positioning of an armchair, wheelchair or other comfortable seat. It is intended that the user will position him/herself in a chair while the table surface is in a raised position. The table surface may then be lowered by the user pulling the table surface downward until the table surface rests comfortably on the arms of the chair or the lap of the user. When the user is finished with the table surface the user can manually raise the table surface to the desired height.

DETAILED DESCRIPTION OF THE INVENTION

Figure 1:
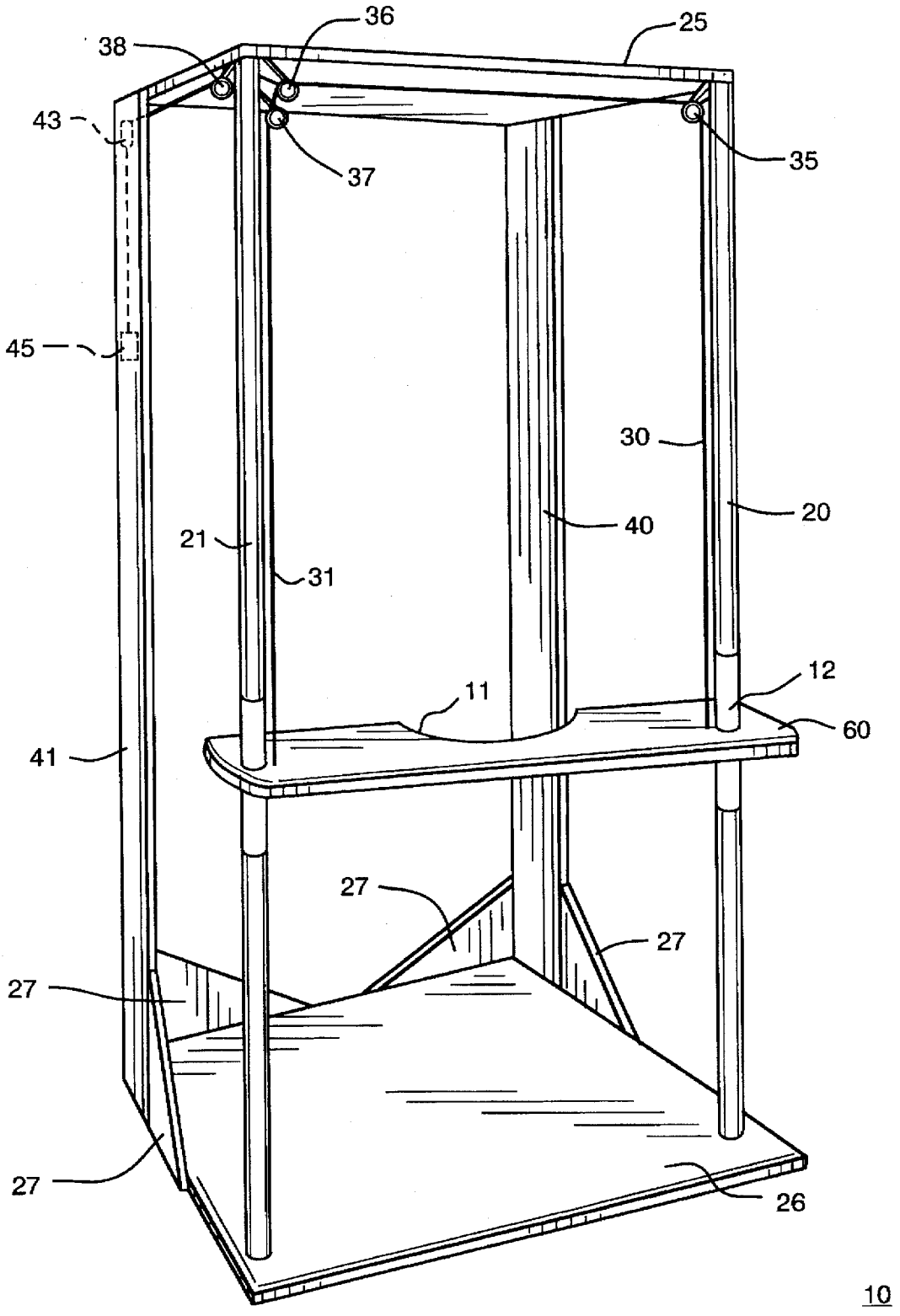
FIG. 1 is a perspective view of the table apparatus in accordance with the present invention.

FIG. 1 shows a perspective view of the invention. Table surface 60 moves in a vertical plane along the length of guideposts 20, 21 which are securely attached to top support 25 and bottom support 26. Box posts 40, 41 provide for additional stability of the apparatus. Gussets 27, fastened between box posts 40, 41 and bottom support 26 further strengthen the structure. Guideposts 20, 21 are of sufficient length to allow an individual to pass beneath the table surface 60 when table surface 60 is in a raised position. Table surface 60 is raised and lowered with the use of a pulley cable system. Cables 30 and 31 are attached on opposing ends of table surface 60. Cable 30 runs through pulley 35 and then runs horizontally to pulley 36. Cable 31 runs through pulley 37 where cables 30 and 31 meet and passes through double pulley 38. Counterweight 45 is attached to cables 30 and 31. Counterweight 45 balances table surface 60 such that table surface 60 can be raised or lowered with minimal effort to accommodate the needs of a user having limited arm strength.

When the user manually raises table surface 60, counterweight 45 is lowered as attached cables 30, 31 run through the pulleys. Counterweight 45 is raised when table surface 60 is manually lowered.

In one of the preferred embodiments, as shown in FIG. 1, table surface 60 is about 38 inches long, 16 inches wide and ½ inch thick. The top can be made from plywood or chip board, metal, plastic or other materials suitable for tray or table surfaces. If plywood is used, then FORMICA or other similar covering should be used to cover the top by gluing the FORMICA to the top of surface 60 with contact cement or other adhesives well known in the art.

A reinforcing piece runs the length of the bottom side of the plywood. This piece measures 38 inches long, 3.5 inches wide and ¾ inches thick. A semi-circle cut 11 is made in the table surface measuring about 14 inches long with a depth of 2 inches. The outside corners of table surface 60 may be rounded. A 1.25 inch hole is drilled on each end of table surface 60. The holes are spaced about 34 inches apart measured from centers lengthwise and are centered widthwise. A piece of 6 inch long electrical conduit tubing 12 is placed within each interior of the table surface holes. The diameter of the tubing is about 1 1/16 inches allowing for a snug fit. Guideposts are composed of schedule 40 PVC pipe and are secured within the interior of each conduit tubing. The guideposts measure about 75 inches in length and 1 1/16 inches in diameter. The length of the guideposts can be adapted to accommodate situations where less ceiling clearance is available. The guideposts 20, 21 are reinforced with steel conduit tubing pieces wrapped with electrical tape and inserted into each guidepost. Each guidepost is secured by a top panel 25 and a bottom panel 26. Each panel measures about 37 inches in length by 36 inches in width. The ends of panels 25, 26 which oppose the ends supporting guideposts 20, 21 are supported by box posts 40, 41, measuring about 75 inches in length. A 1 1/16 inch diameter cavity is located about 2 inches from the top of rear box post 41. A single pulley 25 with a ¾ inch diameter sheave is secured to the upper corner of guidepost 20. Two single pulleys 36, 37 with the same diameter sheaves are also secured to the upper corner of guidepost 21. A double pulley 38 is secured to the upper corner of guidepost 21 behind the single pulleys 36, 37. A ¼ inch diameter nylon rope is used as cable 30, however, other materials such as polypropylene, steel cable, etc. could also be used. Cables 30, 31 are attached to table surface 60 near both guideposts 20, 21. Cable 30 is about 18 feet in length and runs up to pulley 35 and then through single pulley 36 to double pulley 38. Cable 31 is about 15 feet in length and runs up to pulley 37 to meet with cable 30 and is fed through the double pulley 38. Both cables 30, 31 are fed through cavity 43 in the rear box post 41. Cables 30, 31 are attached to counterweight 45 which is a 7 lb round window weight or any similar object having a similar size and weight.

Changing the weight of table surface 60, the height of guideposts 20, 21 and the mechanical advantage obtained by the pulley system for cables 30, 31 would necessitate modification of the counterweight and the length of the cables using techniques well known in the art.

This configuration allows for the user to place a comfortable chair (not shown) between guideposts 20, 21 and box posts 40, 41. It is intended that the user will approach the chair when table surface 60 is in a raised position. Once seated, the user will pull table surface 60 down until it reaches the desired placement. When the user desires to get up from the chair, the user will push table surface 60 upward until it has reached a height appropriate for the user to leave the apparatus unobstructed.

Figure 2:
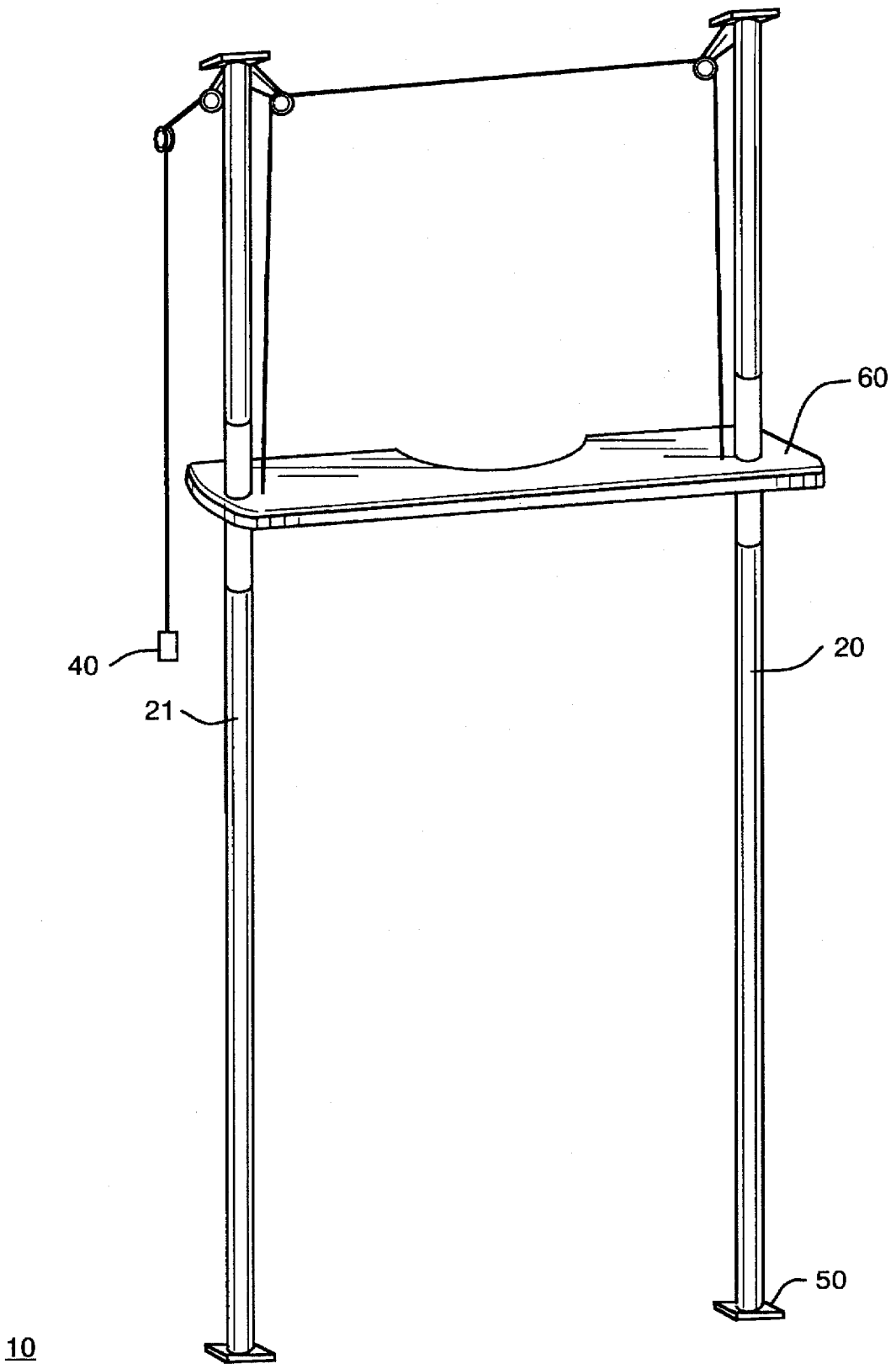
FIG. 2 is a perspective view of an alternative embodiment of the table apparatus in accordance with the present invention.

FIG. 2 is a perspective view of an alternative embodiment. In this embodiment guideposts 20, 21 are of sufficient length such that they may be secured to the ceiling and the floor with posts 50 secured to each end of both guideposts 20, 21. Counterweight 45 is attached to the side of guidepost 21. This embodiment works in the same manner as the embodiment shown in FIG. 1. However, in this embodiment the guideposts are secured directly into the ceiling and the floor rather than securing them with the box posts and top and bottom supports.

While the preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

What is claimed is:

1. A table and chair combination that enables a user to enter and exit said chair without removing said table away from the front of said chair, said table and chair combination comprising:

a table surface having opposing sides, said table surface being moveable in a vertical direction;

a chair having arms and a height wherein said chair is positioned behind said table;

two vertical guideposts, each having a top end, a bottom end and a length greater than the height of said chair, wherein said opposing sides of said table surface are slidably connected to said guideposts between the top end and the bottom end and wherein said guideposts are fixed in a stationary position in front of and on either side of said chair;

a pulley system having a mechanical advantage and having at least one flexible cable having one end attached to said table surface and another end attached to a counterweight, wherein the weight of said counterweight corresponds to the weight of said table surface and the mechanical advantage of said pulley system, such that said table surface may be lowered by said user to place said table surface upon said arms of said chair placed between said guide posts so that said table surface is positioned in front of a user seated in said chair and such that said user can raise said table surface while seated in said chair so that said user can pass under said table surface when exiting said chair.

2. The table and chair combination of claim 1 wherein said pulley system further comprises two flexible cables having an end attached to said opposing sides of said table surface.

3. The table and chair combination of claim 1 further comprising:

two rear support posts opposing said guideposts and corresponding to said guideposts;

a top support and a bottom support attached to said guideposts and rear support posts wherein said top and bottom supports, said guideposts and said support posts forming a substantially rectangular shaped self-supporting structure and such that said chair may be positioned on said bottom support between said guideposts forward of said rear support posts.

4. The table and chair combination of claim 1 wherein said guideposts are secured to the ceiling and the floor.

5. The table and chair combination of claim 1 wherein said table surface further comprises a semi-circle cutout which faces said chair.

* * * * *